US009535362B2

(12) United States Patent
Kakehi et al.

(10) Patent No.: US 9,535,362 B2
(45) Date of Patent: Jan. 3, 2017

(54) CARRIER SET FOR ELECTROSTATIC CHARGE IMAGE DEVELOPER, ELECTROSTATIC CHARGE IMAGE DEVELOPER SET, AND PROCESS CARTRIDGE

(71) Applicant: FUJI XEROX CO., LTD., Tokyo (JP)

(72) Inventors: Soutaro Kakehi, Kanagawa (JP); Moegi Iguchi, Kanagawa (JP); Sakon Takahashi, Kanagawa (JP); Akihiro Iizuka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/806,032

(22) Filed: Jul. 22, 2015

(65) Prior Publication Data

US 2016/0282753 A1 Sep. 29, 2016

(30) Foreign Application Priority Data

Mar. 24, 2015 (JP) ..... 2015-061679

(51) Int. Cl.
*G03G 9/08* (2006.01)
*G03G 15/08* (2006.01)
*G03G 9/10* (2006.01)

(52) U.S. Cl.
CPC ..... *G03G 15/0808* (2013.01); *G03G 9/10* (2013.01)

(58) Field of Classification Search
CPC ..... G03G 9/10
USPC ..... 430/111.1, 111.4
See application file for complete search history.

(56) References Cited

U.S. PATENT DOCUMENTS

2008/0081278 A1* 4/2008 Matsumoto ..... G03G 9/09708 430/111.35

FOREIGN PATENT DOCUMENTS

| | | | |
|---|---|---|---|
| JP | 2011-069955 | A | 4/2011 |
| JP | 2011-164210 | A | 8/2011 |
| JP | 2013-134260 | A | 7/2013 |
| JP | 2014-174475 | A | 9/2014 |

* cited by examiner

*Primary Examiner* — Mark A Chapman
(74) *Attorney, Agent, or Firm* — Oliff PLC

(57) ABSTRACT

A carrier set for electrostatic charge image developer, includes: a first carrier that satisfies Expression (1); 160 mJ≤x≤200 mJ, and a second carrier that satisfies Expression (2); 210 mJ≤y≤250 mJ, wherein x is a total energy amount, which is measured by a powder rheometer, of a developer which is prepared by mixing the first carrier and a toner for measurement such that a weight ratio of the toner is 8% by weight based on the developer, and y is a total energy amount, which is measured by the powder rheometer, of a developer which is prepared by mixing the second carrier and the toner for measurement such that a weight ratio of the toner is 8% by weight based on the developer.

15 Claims, 4 Drawing Sheets

CARRIER SET FOR ELECTROSTATIC CHARGE IMAGE DEVELOPER, ELECTROSTATIC CHARGE IMAGE DEVELOPER SET, AND PROCESS CARTRIDGE

CROSS-REFERENCE TO RELATED APPLICATIONS

This application is based on and claims priority under 35 USC 119 from Japanese Patent Application No. 2015-061679 filed Mar. 24, 2015.

BACKGROUND

Technical Field

The present invention relates to a carrier set for electrostatic charge image developer, an electrostatic charge image developer set, and a process cartridge.

SUMMARY

According to an aspect of the invention, there is provided a carrier set for electrostatic charge image developer, including:

a first carrier that satisfies Expression (1); 160 mJ≤x≤200 mJ, and a second carrier that satisfies Expression (2); 210 mJ≤y≤250 mJ, wherein x is a total energy amount, which is measured by a powder rheometer, of a developer which is prepared by mixing the first carrier and a toner for measurement such that a weight ratio of the toner is 8% by weight based on the developer, and y is a total energy amount, which is measured by the powder rheometer, of a developer which is prepared by mixing the second carrier and the toner for measurement such that a weight ratio of the toner is 8% by weight based on the developer.

BRIEF DESCRIPTION OF THE DRAWINGS

Exemplary embodiments of the present invention will be described in detail based on the following figures, wherein.

DETAILED DESCRIPTION

Figure 1:
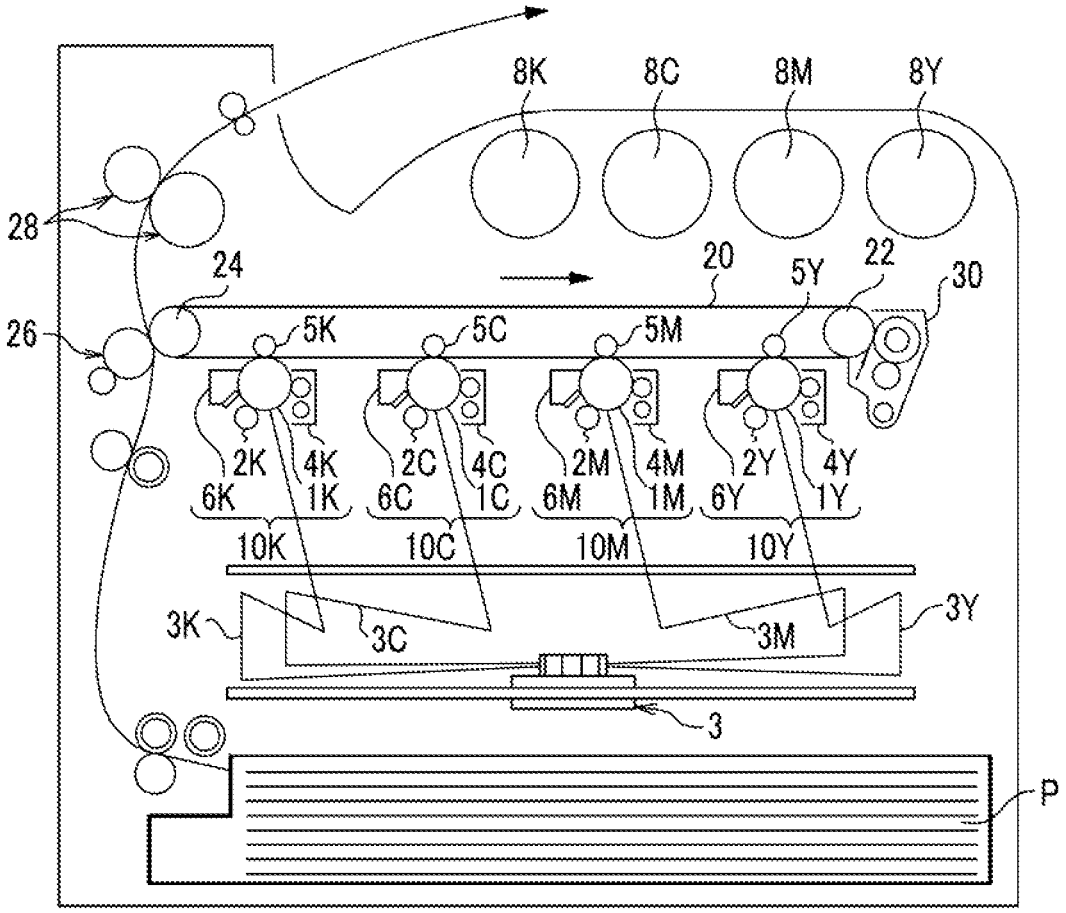
FIG. 1 is a schematic configuration view illustrating an example of an image forming apparatus according to the exemplary embodiment.

Hereinafter, an exemplary embodiment of the present invention will be described. The description and Examples are examples of the present invention, and a scope of the present invention is not limited thereto.

In the specification, (meth)acryl means acryl or methacryl, (meth)acrylic acid means acrylic acid or methacrylic acid, and (meth)acrylo means acrylo or methacrylo.

Carrier Set

A carrier set for electrostatic charge image developer (simply referred to as a "carrier set" in some cases) according to the exemplary embodiment includes a first carrier which satisfies the following Expression (1) and a second carrier which satisfies the following Expression (2).

$$160\ \text{mJ} \le x \le 200\ \text{mJ} \qquad \text{Expression (1)}$$

$$210\ \text{mJ} \le y \le 250\ \text{mJ} \qquad \text{Expression (2)}$$

x in Expression (1) is a total energy amount, which is measured by a powder rheometer, of a developer which is prepared by mixing the first carrier and a toner for measurement such that toner weight ratio is 8% by weight.

y in Expression (2) is a total energy amount, which is measured by the powder rheometer, of a developer which is prepared by mixing the second carrier and the toner for measurement such that toner weight ratio is 8% by weight.

In the exemplary embodiment, the measurement of the total energy amount by the powder rheometer is performed under the conditions that a speed at a tip end of a rotary blade is 100 mm/sec, an approach angle of the rotary blade is −4° C., and a ventilation flow rate is 0 ml/min.

A toner for measurement which is mixed with the first carrier and the second carrier for measuring the total energy amount is a toner which is obtained by mixing with 100 parts f toner particles having a volume average particle diameter of 6.5 μm, a volume average particle diameter distribution index of 1.2, and a shape factor SF1 of 120 to 125, 1.2 parts of hydrophobic titania, and 1.8 parts of hydrophobic silica.

The total energy amount of the developer which is measured by the powder rheometer shows fluidity of the developer. As the total energy amount increases, fluidity of the developer decreases, and as the total energy amount decreases, fluidity of the developer increases.

A measurement method of the total energy amount and a toner which is used for measuring the total energy amount according to the exemplary embodiment will be described later in more detail.

According to the carrier set of the exemplary embodiment, formation of an auger mark (density unevenness having a shape of a stripe which is formed on an image by defective agitating of the developer in a developing device) which is caused when image forming is repeated over a long period of time is prevented. The mechanism of action is not always apparent, but the following is assumed.

In the related art, a two-component developer which is charged by mixing and agitating the toner and the carrier with each other is known. The developing device which uses the two-component developer has a developer accommodation chamber provided with an agitating unit, makes the toner charged by agitating the two-component developer inside the developer accommodation chamber, and uses the charged toner in developing an electrostatic charge image. Since the toner is consumed as the image forming is repeated, the two-component developer in the developer accommodation chamber is controlled such that the toner weight ratio is in a determined range, for example, by a replenishing unit which replenishes the developer accommodation chamber with the toner having an amount corresponding to a density of the image to be formed.

In addition, as a developing method which is employed in the developing device, a so-called trickle developing method which replenishes the developer accommodation chamber with the toner and the carrier, and discharges the developer (hereinafter, there is a case where the developer is referred to as a "deteriorated developer") including a large amount of deteriorated carrier, is known.

However, when an amount of the developer which is accommodated in the developer accommodation chamber of the developing device increases or decreases, an image defect which is called an auger mark is formed on the image. In the developing device in which the trickle developing method is employed, for example, the following phenomenon may be generated.

In general, a supplying force or an agitating force of the developer decreases as the size of the developing device decreases. When the size of the developing device is reduced, a developer which has a relatively high fluidity is employed in the developing device. However, when the fluidity of the developer which is accommodated in the developer accommodation chamber is high, discharging of the deteriorated developer is accelerated, and in some cases, the amount of the developer in the developer accommodation chamber tends to decrease. In particular, in the case where the density of the image which is repeatedly formed is low, a replenishment amount of the toner is controlled to is further decreased, a difference between the replenishment amount of the toner and the carrier and a discharge amount of the deteriorated developer increases, and the amount of the developer in the developer accommodation chamber is likely to have a tendency of decreasing.

On the contrary, when the developer having a low fluidity which does not correspond to the supplying force or the agitating force of the developing device is employed, the discharging of the deteriorated developer is prevented, and in some cases, the amount of the developer in the developer accommodation chamber tends to increase. In particular, in the case where the density of the image which is repeatedly formed is high, the replenishment amount of the toner is controlled to be increased, a difference in a reverse direction increases, and the amount of the developer in the developer accommodation chamber is likely to have a tendency of increasing.

In any case, when the image forming is repeated, an increase and decrease in the amount of the developer which is accommodated in the developer accommodation chamber exceeds an allowable range, and as a result, an auger mark is formed on the image.

In contrast, in the exemplary embodiment, a carrier set which is combined with the first carrier that satisfies the Expression (1) and the second carrier that satisfies the Expression (2) is provided, and by this carrier set, formation of an auger mark on the image is prevented.

The first carrier which satisfies the Expression (1) is a carrier which is intended to be accommodated in the developer accommodation chamber of the developing device at the beginning of the use of the developing device, and is a carrier which is intended to configure the two-component developer and have higher fluidity than that of the second carrier. In addition, the second carrier which satisfies the Expression (2) is a carrier which is intended to be used as a replenishment carrier to be replenished to the developer accommodation chamber of the developing device.

The carrier set of the exemplary embodiment prevents accumulation of a difference between the replenishment amount of the toner and the carrier and the discharge amount of the deteriorated developer, and prevents the formation of an auger mark which is caused when the image forming is repeated over a long period of time by substituting the carrier which configures the two-component developer accommodated in the developer accommodation chamber of the developing device from the first carrier to the second carrier, and by decreasing the fluidity of the two-component developer (however, by decreasing the fluidity only to an extent that transporting properties of the developer are not spoiled) as the image forming is repeated.

The first carrier in the exemplary embodiment is a carrier which satisfies the above-described Expression (1): 160 mJ≤x≤200 mJ.

In the developer which is configured of a carrier in which x is less than 160 mJ, the fluidity is too high, and even when the carrier in the developer is substituted with the second carrier, the amount of the developer of the developer accommodation chamber tends to decrease when the image forming is repeated, and as a result, an auger mark is formed. From this point of view, x is 160 mJ or greater, preferably 165 mJ or greater, and more preferably 170 mJ or greater.

In the developer which is configured of a carrier in which x exceeds 200 mJ, the fluidity is too low, the fluidity further decreases when the carrier in the developer is substituted with the second carrier, the amount of the developer of the developer accommodation chamber tends to increase when the image forming is repeated, and as a result, an auger mark is formed. From this point of view, x is 200 mJ or less, preferably 195 mJ or less, and more preferably 190 mJ or less.

The second carrier in the exemplary embodiment is a carrier which satisfies the above-described Expression (2): 210 mJ≤y≤250 mJ.

Even when the first carrier in the developer is substituted with the carrier in which y is less than 210 mJ, the fluidity of the developer cannot be sufficiently decreased, and the amount of the developer of the developer accommodation chamber tends to decrease when the image forming is repeated, and as a result, an auger mark is formed. From this point of view, y is 210 mJ or greater, preferably 215 mJ or greater, and more preferably 220 mJ or greater.

When the first carrier in the developer is substituted with the carrier in which y exceeds 250 mJ, the fluidity of the developer decreases too much, the amount of the developer of the developer accommodation chamber tends to increase when the image forming is repeated, and as a result, an auger mark is formed. From this point of view, y is 250 mJ or less, preferably 245 mJ or less, and more preferably 240 mJ of less.

In the increase and decrease in the total amount of the developer which is accommodated in the developer accommodation chamber, a (after/before) weight ratio after and before forming 30,000 images having a toner applied amount of 4.2 g/m$^2$ and an area of 0.06 m$^2$ is preferably from 0.6 to 1.4, more preferably from 0.7 to 1.3, and still more preferably from 0.8 to 1.2

Hereinafter, a measurement method of the total energy amount and the toner which is used for measuring the total energy amount will be described.

Measurement Method of Total Energy Amount by Powder Rheometer

The powder rheometer is a fluidity measurement device which measures a rotating torque and a vertical load which are obtained as the rotary blade rotates in a spiral shape in filled particles at the same time, and directly acquires the fluidity. By measuring both the rotating torque and the vertical load, the fluidity which includes characteristics of the powder itself and the influence of the external environment is detected. In addition, since the measurement is performed after setting a state of being filled with the particles in a determined range, data which has excellent reproducibility may be obtained.

FT4 manufactured by Freeman Technology is used as the powder rheometer and measurement is performed. In addition, in order to eliminate an influence of temperature and humidity before measurement, a developer which is kept for 8 hours or more under an environment in which the temperature is 25° C. and the humidity is 25% RH is used.

First, a split container having an inner diameter of 25 mm (a container which has a cylinder having a height of 22 mm on a container having a height of 61 mm and a volume of 25 mL, and may be separated into upper and lower parts) is filled with a developer of which an amount exceeds 61 mm in height.

After filing the container with the developer, an operation of performing homogenization of a sample by agitating the filled developer is performed. Hereinafter, this operation is called "conditioning".

In conditioning, the sample is homogenized by agitating the rotary blade in a rotating direction without receiving resistance from the toner so as not to give stress to the filled developer, and thereby removing the air and a partial stress. A specific condition for conditioning is that the inside of the container is stirred from 70 mm to 2 mm in height from a bottom surface, at 4° in an approach angle, and at 40 mm/sec of speed of the tip end of the rotary blade.

At this time, since the propeller type rotary blade rotates and moves downward at the same time, the tip end thereof draws a spiral, and an angle of a path of the spiral which is drawn by the propeller tip end at this time is called the approach angle.

After repeating the conditioning operation 4 times, an upper end portion of the container of the split container is moved, and at a position which is 61 mm in height, the developer in a vessel is leveled, and a toner which fills up the container having a volume of 25 mL is obtained. The conditioning operation is performed because it is essential to obtain the powder having a volume in a determined range for stably acquiring the total energy amount.

After performing the conditioning operation 1 time, the rotating torque and the vertical load are measured when rotating is performed at 100 mm/sec of speed of the tip end of the rotary blade while moving from 55 mm to 2 mm in height from the bottom surface in the container at −4° C. in an approach angle. The rotating direction of a propeller at this time is a direction reverse (clockwise when viewed from above) to a direction of the conditioning.

Figure 2A:
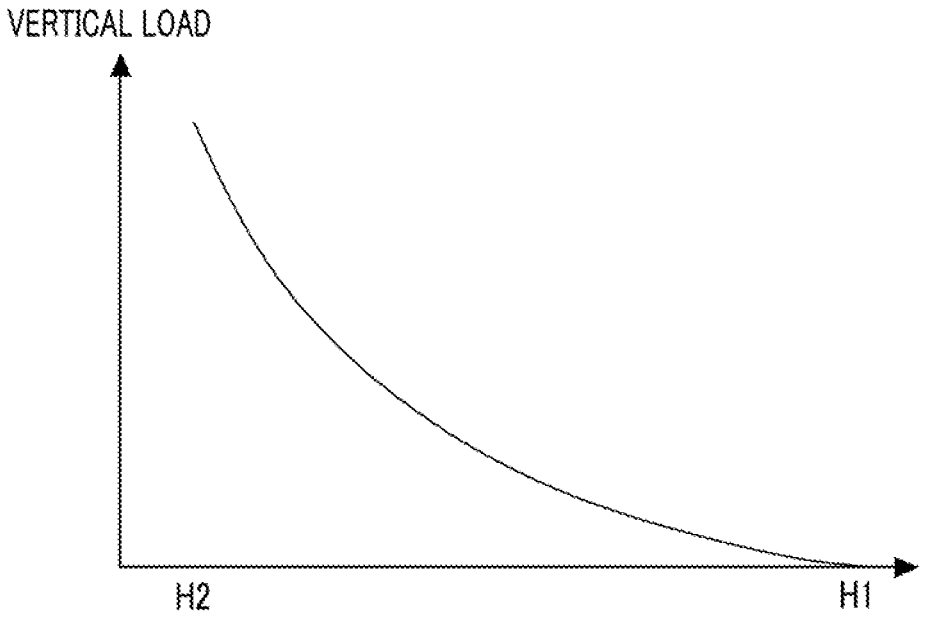
FIGS. 2A and 2B are views illustrating a measurement method of a total energy amount by a powder rheometer.
Figure 2B:
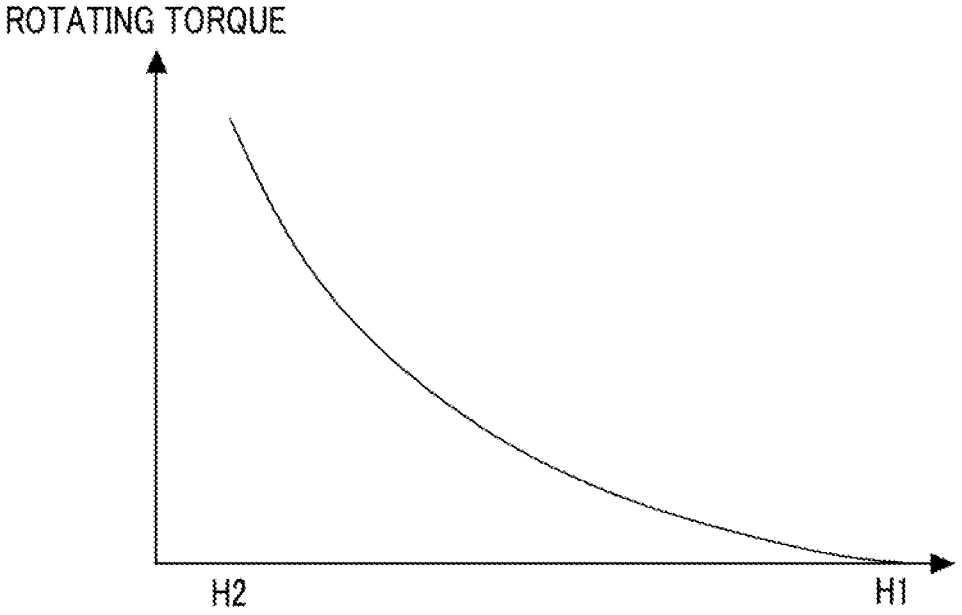
Figure 3:
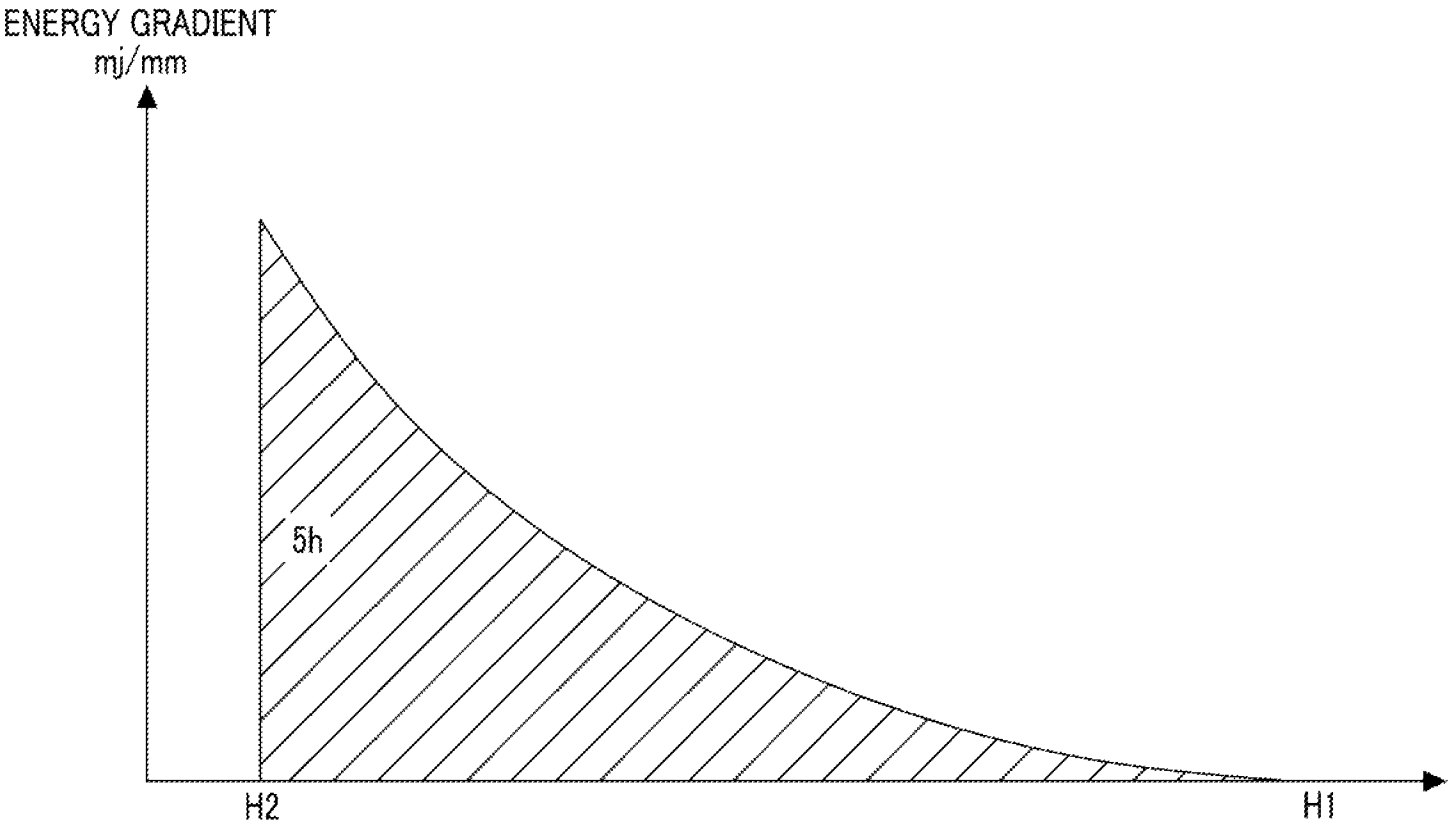
FIG. 3 is a view illustrating a relationship between a vertical load and an energy gradient, which is obtained by the powder rheometer.

A relationship between the vertical load or the rotating torque with respect to a height H from the bottom surface is illustrated in FIG. 2A or 2B. The energy gradient (mJ/mm) with respect to the height H which is acquired from the rotating torque and the vertical load is illustrated in FIG. 3. An area (a shaded part in FIG. 3) which is obtained by integrating the energy gradient of FIG. 3 is the total energy amount (mJ). The total energy amount is acquired by integrating a section from 2 mm to 55 mm in height from the bottom surface.

In addition, an average value which is obtained by performing a cycle of conditioning and energy measurement operation 5 times in order to reduce the influence of an error is set as the total energy amount (mJ).

Figure 4:
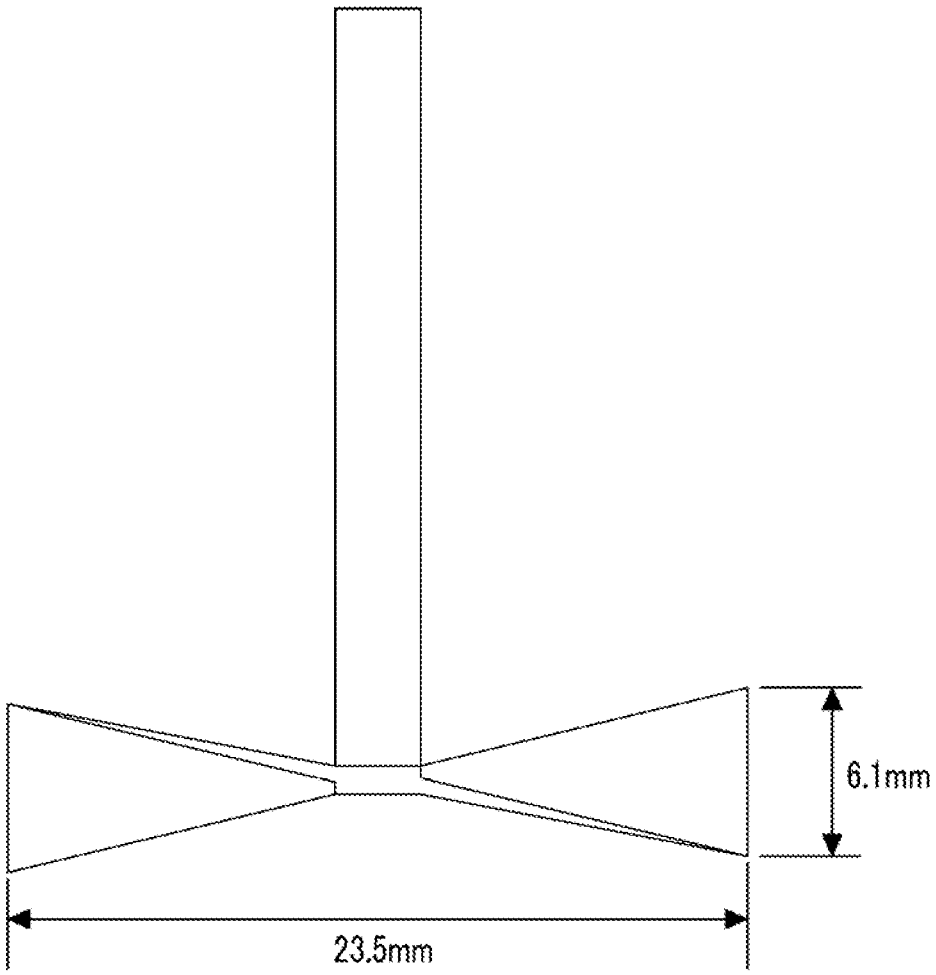
FIG. 4 is a schematic view illustrating a shape of a rotary blade which is used in the powder rheometer.

The rotary blade is a two-blade propeller type having a diameter of ϕ23.5 mm which is illustrated in FIG. 4 and manufactured by Freeman Technology.

In addition, when measuring the rotating torque and the vertical load of the rotary blade, in the exemplary embodiment, measuring is performed by setting the ventilation flow rate from the bottom portion of the container to 0 ml/min. In addition, a flow state of the ventilation flow rate is controlled in FT4 manufactured by Freeman Technology.

Toner Used for Measuring Total Energy Amount

In the exemplary embodiment, the total energy amount of the developer which is prepared by mixing the carrier (the first carrier and the second carrier) and the toner with each other is measured. The toner which is used for measuring the total energy amount is a toner which is prepared by mixing toner particles, with hydrophobic titania and hydrophobic silica as external additives at the weight ratio of 100:3. The weight ratio of hydrophobic titania and hydrophobic silica is 1.2:1.8.

The toner particles, hydrophobic titania, and hydrophobic silica used have the following physical properties, respectively.

Toner Particles

Volume average particle diameter: 6.5 μm

Volume average particle diameter distribution index: 1.2

Shape factor SF1: 120 to 125

Hydrophobic Titania

Volume average particle diameter: 0.02 m (for example, JMT2000 manufactured by Fuji Titanium Industry Co., Ltd.)

Hydrophobic Silica

Volume average particle diameter: 0.04 μm (for example, RY50 manufactured by Nippon Aerosil Co., Ltd.)

The volume average particle diameter, the volume average particle diameter distribution index, and the shape factor SF1 of the toner particles are synonymous with a volume average particle diameter (D50v), a volume average particle diameter distribution index (GSDv), and a shape factor SF1 which will be described later, respectively, and the measurement methods thereof are the same.

As the toner particles which configure the toner for measuring the total energy amount, toner particles which configure a known toner which is practically used in the image forming apparatus may be employed, and toner particles which are prepared with materials and preparing methods which will be described later may be employed. As a binder resin of the toner particles, at least one selected from a styrene acrylic resin and a polyester resin is preferable. It is preferable that the toner particles contain a coloring agent and a release agent.

The external additive (hydrophobic titania and hydrophobic silica) is externally added to the toner particles by mixing the materials for 3 minutes at a circumferential speed of 33 m/s using a HENSCHEL mixer.

Mixing of the toner for measuring the total energy amount and the carrier is performed by mixing 8 parts by weight of the toner and 92 parts by weight of the carrier for 20 minutes at 20 rotations per minute using a V blender.

Hereinafter, materials, preparing methods, and physical properties of the first carrier and the second carrier will be described in detail.

Second Carrier

First, the second carrier will be described.

The second carrier is not particularly limited, as long as it is a carrier which satisfies the above-described Expression (2), and a known carrier may be employed as a carrier for the two-component developer.

From the viewpoint of satisfying the above-described Expression (2), it is preferable to employ a magnetic carrier of the following (a) as the second carrier.

(a) A magnetic carrier which includes a core containing magnetic particle, and a coating layer which contains a coating resin and oil treated resin particles, and coats the core.

Furthermore, in the magnetic carrier of the (a), it is preferable that the oil treated resin particles are exposed on a surface of the coating layer. In this case, at least a part of all of the particles may be exposed, or a part of individual particles may be exposed.

Hereinafter, the magnetic carrier of the (a) will be described.

Core Containing Magnetic Particle

Examples of the core containing the magnetic particles (hereinafter, simply referred to as a "core" in some cases) include a core which is formed of particle-shaped magnetic particle; a core in which the magnetic particles are dispersed in the resin; and a core in which porous magnetic particle are impregnated with the resin.

Examples of the magnetic particle include a magnetic metal (e.g., iron, nickel, and cobalt), and a magnetic oxide (e.g., ferrite and magnetite).

Examples of the resin which configures the core include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to have an organosiloxane bond or a modified article thereof, a fluorine resin, polyester, polycarbonate, a phenol resin, or an epoxy resin. These resins may be used alone or in combination of two or more kinds thereof.

The resin which configures the core may contain an additive, such as conductive particles. Examples of the conductive particles include particles of metal (e.g., gold, silver, and copper), carbon black, titanium oxide, zinc oxide, tin oxide, barium sulfate, aluminum borate, and potassium titanate.

As the core, particle-shaped magnetic particle is preferable. In this case, the volume average particle diameter of the magnetic particles which constitute the core is, for example, preferably from 20 μm to 50 μm. As the magnetic particle which constitutes the core, ferrite, magnetite or the like is preferable.

The volume average particle diameter of the core is, for example, preferably from 20 μm to 50 μm.

Coating Layer Examples of the coating resin which configures the coating layer include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to have an organosiloxane bond or a modified article thereof, a fluorine resin, polyester, polycarbonate, a phenol resin, or an epoxy resin. These resins may be used alone or in combination of two or more kinds thereof. As the coating resin, a homopolymer or a copolymer of cyclohexyl methacrylate is preferable.

Oil Treated Resin Particles

The coating layer includes resin particles which are oil treated (hereinafter, referred to as "oil treated resin particles in some cases).

Examples of the resin particles which configure the oil treated resin particles include particles which are formed of a resin or an elastomer (e.g., silicone, polystyrene, polymethyl methacrylate, polyethyl methacrylate, a methyl methacrylate-styrene copolymer, and styrene-butadiene rubber).

Examples of oil which is used in oil treating of the resin particles include dimethylsilicone oil, methylphenyl silicone oil, silicone oil containing an amino group, fluorine-modified silicone oil, epoxy-modified silicone oil, and mercapto-modified silicone oil.

The oil treating of the resin particles may be performed by a method of dispersing the resin particles in an oil which is dissolved in alcohol and distilling alcohol by an evaporator to dry the resultant. An amount of oil which is used in the treating is from 5 parts by weight to 40 parts by weight, and preferably from 10 parts by weight to 30 parts by weight with respect to 100 parts by weight of the resin particles.

As the oil treated resin particles, oil treated silicone particles are preferable.

The silicone particles are polysiloxane particles. A molecular structure of silicone may be linear, branched, or may have a mixture of the linear and branched structures. Examples of an organic group which is bonded to a silicon atom include an alkyl group (e.g., a methyl group, an ethyl group, and a propyl group), an aryl group (e.g., a phenyl group and a tolyl group), and a halogenated alkyl group (e.g., a chloromethyl group).

The silicone particles may be silicone resin particles or silicone rubber particles, and more specifically, examples thereof include a crosslinked body of dimethyl polysiloxane, and polysilsesquioxane and a derivative thereof, which are in a particle shape. Examples of silicone particles which are available on the market include X-24 and X-22 manufactured by Shin-Etsu Chemical Co., Ltd.

A volume average particle diameter of the oil treated resin particles is, for example, preferably from 0.1 μm to 10 μm.

From the viewpoint of satisfying the above-described Expression (2), a content of the oil treated resin particles is preferably from 0.05% by weight to 0.2% by weight, and more preferably from 0.075% by weight to 0.175% by weight, and still more preferably from 0.1% by weight to 0.15% by weight of the entire carrier.

From the viewpoint of satisfying the above-described Expression (2), it is preferable that at least a part of all of the oil treated resin particles is exposed on the surface of the coating layer. In addition, from the viewpoint of satisfying the above-described Expression (2), a coverage (%) of the surface of the carrier by the oil treated resin particles is preferably from 0.1% to 10%, more preferably from 0.25% to 5%, and still more preferably from 0.5% to 1%.

A state where the oil treated resin particles are exposed on the surface of the coating layer, and the coverage of the surface of the carrier by the oil treated resin particles may be confirmed by X-ray photoelectron spectroscopy (XPS).

The coating layer may contain the resin particles which are not oil treated. Examples of the resin particles include particles of, for example, silicone resin, polystyrene, polymethyl methacrylate, and melamine resin. The volume average particle diameter of the resin particles is, for example, preferably from 0.1 μm to 10 μm.

When the coating layer contains the resin particles which are not oil treated, the content of the resin particles is preferably from 0.05% by weight to 0.2% by weight, more preferably from 0.075% by weight to 0.175% by weight, and still more preferably from 0.1% by weight to 0.15% by weight of the entire carrier.

The coating layer may contain the additive, such as conductive particles. Examples of the conductive particles include particles of a metal (e.g., gold, silver, and copper), and carbon black, titanium oxide, zinc oxide, tin oxide, barium sulfate, aluminum borate, and potassium titanate.

Examples of a method of forming the coating layer on the surface of the core include a method which uses a coating layer forming solution in which the coating resin and various additives are dissolved in a solvent.

Specific examples of the method include a dipping method of dipping the core in the coating layer forming solution, a spray method of spraying the coating layer forming solution onto the surface of the core, a fluid bed method of spraying the coating layer forming solution in a state where the core floats by fluid air, and a kneader-coater method of mixing the core and the coating layer forming solution in the kneader-coater and then, removing the solvent.

The solvent which configures the coating layer forming solution is not particularly limited, and may be selected by considering the type or excellency in coating of the coating resin used or coating suitability.

Examples of a method of making the oil treated resin particles be contained in the coating layer include a method of forming the coating layer on the surface of the core by using the coating layer forming solution to which the oil treated resin particles are added. Other than this, examples also include a method of making the oil treated resin particles be adhered and thus contained in the coating layer by mixing and stirring the carrier and the oil treated resin particles after making the carrier which has the coating layer formed of the coating resin on the surface of the core.

An average thickness of the coating layer is, for example, preferably from 0.1 μm to 1 μm.

The coverage of the surface of the core by the coating layer is preferably 80% or greater, more preferably 90% or greater, and may be 100%. The coverage of the surface of the core by the coating layer is acquired by the X-ray photoelectron spectroscopy (XPS).

From the viewpoint of satisfying the above-described Expression (2), as the second carrier, a magnetic carrier of the following (d) is also preferable.

(d) A magnetic carrier which is prepared by performing oil treating on the surfaces of the magnetic carriers of the above-described (a), or (b) or (c) which will be described later.

Examples of oil which is used in the oil treating of the magnetic carrier for obtaining the above-described (d) include dimethylsilicone oil, methylphenyl silicone oil, silicone oil containing an amino group, fluorine-modified silicone oil, epoxy-modified silicone oil, and mercapto-modified silicone oil. The oil treating of the magnetic carrier may be performed by the method of distilling and drying alcohol by using an evaporator after dispersing the magnetic carrier in the oil which is dissolved in alcohol. An amount of oil which is used in the treating is from 0.1 parts by weight to 10 parts by weight, and preferably from 0.5 parts by weight to 5 parts by weight with respect to 100 parts by weight of the magnetic carrier The volume average particle diameter of the second carrier is, for example, preferably from 20 μm to 50 μm.

First Carrier

Next, the first carrier will be described.

The first carrier is not particularly limited as long as the carrier satisfies the above-described Expression (1), and a carrier known as a carrier for the two-component developer may be employed.

From the viewpoint of satisfying the above-described Expression (1), as the first carrier, a magnetic carrier of the following (b) and (c) is preferable.

(b) A magnetic carrier which includes the core containing the magnetic particles; and the coating layer which contains the coating resin and coats the core.

In the magnetic carrier of the (b), the coating layer does not contain the resin particles (resin particles which are oil treated, and resin particles which are not oil treated).

(c) A magnetic carrier which includes the core containing the magnetic particle; and the coating layer which contains the coating resin and the resin particles, and coats the core. The resin particles are resin particles which are not oil treated.

In the magnetic carrier of the (c), the resin particles may be exposed on the surface of the coating layer. In the magnetic carrier of the (c), the coating layer does not contain the oil treated resin particles.

Hereinafter, the magnetic carrier of the (b) and (c) will be described.

The core and the coating resin that contains the magnetic particles in the (b) and (c) are configured similarly to the core and the coating resin which contains the magnetic particles in the second carrier, and a preferable aspect is also similar.

The resin particles in the (c) are the resin particles which are not oil treated, and examples thereof include particles of silicone, polystyrene, polymethyl methacrylate, and melamine resin. The volume average particle diameter of the resin particles which are not oil treated is, for example, preferably from 0.1 μm to 10 μm.

When the coating layer contains the resin particles which are not oil treated, a content of the resin particles is preferably from 0.05% by weight to 0.2% by weight, more preferably from 0.075% by weight to 0.175% by weight, and still more preferably from 0.1% by weight to 0.15% by weight of the entire carrier.

The coating layer may contain the additive, such as conductive particles. Examples of the conductive particles include particles of a metal (e.g., gold, silver, and copper), and carbon black, titanium oxide, zinc oxide, tin oxide, barium sulfate, aluminum borate, and potassium titanate.

Examples of the method of forming the coating layer on the surface of the core include a method which uses a coating layer forming solution in which the coating resin, the resin particles, and various additives as necessary are dissolved in a solvent.

Specific examples of the method include the dipping method of dipping the core in the coating layer forming solution, the spray method of spraying the coating layer forming solution onto the surface of the core, the fluidized bed method of spraying the coating layer forming solution in a state where the core floats by flowing air, and the kneader-coater method of mixing the core and the coating layer forming solution in the kneader-coater and then, removing the solvent.

The solvent for forming the coating layer forming solution is not particularly limited, and may be selected by considering the type of the coating resin used or coating suitability.

An average thickness of the coating layer is, for example, preferably from 0.1 μm to 1 μm.

The coverage of the surface of the core by the coating layer is preferably 80% or greater, more preferably 90% or greater, and may be 100%.

A volume average particle diameter of the first carrier is, for example, preferably from 20 μm to 50 μm.

Electrostatic Charge Image Developer Set

An electrostatic charge image developer set (referred to as a "developer set" in some cases) according to the exemplary embodiment includes the developer which has the toner and the first carrier that satisfies the above-described Expression (1), a replenishment toner, and the second carrier which satisfies the above-described Expression (2) as a replenishment carrier. The replenishment toner may have the same configuration as the toner which configures the developer together with the first carrier, or may have a different configuration, but the toner which has the same configuration is preferable.

In the electrostatic charge image developer which configures the developer set according to the exemplary embodiment, a mixing ratio (weight ratio) between the toner and the first carrier is from 3:100 to 12:100, and preferably from 5:100 to 9:100.

Hereinafter, materials, a preparing method, and physical properties of the toner which configures the developer set according to the exemplary embodiment will be described in detail.

Toner

The toner contains toner particles, and further, may contain an external additive. In other words, the exemplary embodiment may use the toner particles may be used as the toner as they are, and those prepared by externally adding an external additive to the toner particles.

Toner Particles

The toner particles are configured to contain, for example, a binder resin, and as necessary, a coloring agent, a release agent, and other additives.

Binder Resin

Examples of the binder resin include a vinyl resin which is formed of a homopolymer of a monomer, such as styrenes (e.g., styrene, parachlorostyrene, and α-methylstyrene), (meth)acrylic esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinylmethylether and vinyl isobutyl ether), vinyl ketones (e.g., vinyl methyl ketone, vinyl ethyl ketone, and vinyl isopropenyl ketone), olefins (e.g., ethylene, propylene, and butadiene), and a copolymer of two or more of the monomers.

Examples of the binder resin include non-vinyl resin (e.g., an epoxy resin, a polyester resin, a polyurethane resin, a polyamide resin, a cellulose resin, a polyether resin, and a modified rosin), a mixture of these and the above-described vinyl resin, and a graft polymer which is obtained by polymerizing the vinyl monomer under the conditions that these resins are present together.

These binder resins may be used alone or in combination of two or more kinds thereof.

As the binder resin, the polyester resin is appropriate. Example of the polyester resin includes a polycondensate of polyvalent carboxylic acid and polyol.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diol (e.g., ethylene glycol, diethylene glycol, triethylene glycol, propylene glycol, butanediol, hexanediol, or neopentyl glycol), alicyclic diol (e.g., cyclohexanediol, cyclohexanedimethanol, or hydrogenated bisphenol A), or aromatic diol (e.g., ethylene oxide adduct of bisphenol A, or propylene oxide adduct of bisphenol A). Among these, as the polyol, for example, the aromatic diol and the alicyclic diol are preferable, and the aromatic diol is more preferable.

As the polyol, a tri- or higher-valent polyol employing a crosslinked structure or a branched structure may be used in combination with diol. Examples of the tri- or higher-valent polyol include glycerin, trimethylolpropane, or pentaerythritol.

The polyol may be used alone or in combination of two or more kinds thereof.

A glass transition temperature (Tg) of the polyester resin is preferably from 50° C. to 80° C., and more preferably from 50° C. to 65° C.

The glass transition temperature is acquired by a DSC curve which is obtained by differential scanning calorimetry (DSC). More specifically, the glass transition temperature is acquired by an "extrapolated starting temperature of glass transition" described in an acquiring method of the glass transition temperature of a JIS K7121-1987 "transition temperature measurement method of plastic".

A weight average molecular weight (Mw) of the polyester resin is preferably from 5,000 to 1,000,000, and more preferably from 7,000 to 500,000. A number average molecular weight (Mn) of the polyester resin is preferably from 2,000 to 100,000. A molecular weight distribution Mw/Mn of the polyester resin is preferably from 1.5 to 100, and more preferably from 2 to 60.

The weight average molecular weight and the number average molecular weight are measured by gel permeation chromatography (GPC). The measurement of the molecular weight by the GPC is performed in a THF solvent by using HLC-8120, which is a GPC manufactured by Tosoh Corporation as a measurement apparatus and TSKGEL SuperHM-M(15 cm), which is a column manufactured by Tosoh Corporation. The weight average molecular weight and the number average molecular weight are calculated by using a molecular weight calibration curve which is obtained by a monodispersed polystyrene reference sample from the measurement result.

The polyester resin may be obtained by a known preparation method. Specifically, for example, the polyester resin may be obtained by a method in which a polymerization temperature is set to be from 180° C. to 230° C., pressure is reduced in a reaction system as necessary, and a reaction is performed while removing water or alcohol formed during condensation.

When a monomer of a raw material is not dissolved or is not compatible at a reaction temperature, a solvent having a high boiling point may be added as a solubilizing agent and dissolution may be performed. In this case, the polycondensation reaction is performed while distilling the solubilizing agent. When a monomer having a low compatibility exists in a copolymerization reaction, it is preferable that the monomer having a low compatibility is condensed with an acid or alcohol which is planned to be polycondensed with the monomer in advance, and then polycondensed with a main component.

A content of the binder resin, for example, with respect to the entire toner particle, is preferably from 40% by weight to 95% by weight, more preferably from 50% by weight to 90% by weight, and still more preferably from 60% by weight to 85% by weight.

Coloring Agent

Examples of the coloring agent include various types of pigments, such as carbon black, chrome yellow, Hansa yellow, benzidine yellow, threne yellow, quinoline yellow, pigment yellow, permanent orange GTR, pyrazolone orange, vulcan orange, Watchung red, permanent red, brilliant carmine 3B, brilliant carmine 6B, Dupont oil red, pyrazolone red, lithol red, rhodamine B lake, lake red C, pigment red, rose Bengal, aniline blue, ultramarine blue, chalco oil blue, methylene blue chloride, phthalocyanine blue, pigment blue, phthalocyanine green, or malachite green oxalate; and various dyes, such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, or thiazole dye.

The coloring agent may be used alone or in combination of two or more kinds thereof.

As the coloring agent, a surface-treated coloring agent may be used as necessary, and the coloring agent and a dispersing agent may be used together. In addition, plural coloring agents may be used together.

The content of the coloring agent is preferably from 1% by weight to 30% by weight, and more preferably from 3% to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

A melting temperature of the release agent is preferably from 50° C. to 110° C., and more preferably from 60° C. to 100° C.

The melting temperature of the release agent is acquired from a DSC curve which is obtained by differential scanning calorimetry (DSC), by a "melting peak temperature" described in an acquiring method of the melting temperature of a JIS K7121-1987 "Testing methods for transition temperatures of plastics".

The content of the release agent is, for example, preferably from 1% by weight to 20% by weight and more preferably from 5% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single layer structure, or may be toner particles having a so-called core shell structure which is configured of a core (core particles) and a coating layer (shell layer) which coats the core.

Here, for example, the toner particles having the core shell structure may preferably be configured of a core which includes a binder resin and other additives, such as a coloring agent and a release agent as necessary, and a coating layer which includes the binder resin.

The volume average particle diameter (D50v) of the toner particle is preferably from 2 μm to 10 μm, and more preferably from 4 μm to 8 μm.

Various average particle diameters and various particle diameter distribution indexes of the toner particles are measured by using a COULTER MULTISIZER-II (manufactured by Beckman coulter) and an ISOTON-II (manufactured by Beckman coulter) as an electrolyte.

During the measurement, 0.5 mg to 50 mg of the measurement sample is added to 2 ml of aqueous solution having 5% by weight of surfactant (sodium alkylbenzene sulfonate is preferable) as the dispersing agent. This is added to 100 ml to 150 ml of the electrolyte.

Dispersion processing is performed for 1 minute by an ultrasonic homogenizer with respect to the electrolyte which suspends the sample. By the Coulter MULTISIZER-II, the particle diameter distribution of the particle having 2 μm to 60 μm of particle diameter is measured by using an aperture which is 100 μm in an aperture diameter. The number of particles sampled is 50,000.

By drawing cumulative distribution of each of the volume and the number from a small diameter side with respect to a particle diameter range (channel) divided based on the measured particle diameter distribution, a particle diameter which has 16% of cumulation is defined as a volume particle diameter D16v and a number particle diameter D16p, a particle diameter which has 50% of cumulation is defined as a volume average particle diameter D50v and a number average particle diameter D50p, and a particle diameter which has 84% of cumulation is defined as a volume particle diameter D84v and a number particle diameter D84p.

By using these, a volume average particle diameter distribution index (GSDv) is calculated by $(D84v/D16v)^{1/2}$, and a number average particle diameter distribution index (GSDp) is calculated by $(D84p/D16p)^{1/2}$.

The shape factor SF1 of the toner particles is preferably from 110 to 150, and more preferably from 120 to 140.

The shape factor SF1 is obtained through the following equation.

$$SF1=(ML^2/A)\times(\pi/4)\times 100 \quad \text{Equation:}$$

In the above-described equation, ML represents an absolute maximum length of the toner particle, and A represents a projected area of the toner particle.

Specifically, the shape factor SF1 is numerically converted mainly by analyzing a microscopic image or a scanning electron microscopic (SEM) image by the use of an image analyzer, and is calculated as follows. In other words, an optical microscopic image of particles scattered on a surface of a glass slide is put to an image analyzer LUZEX through a video camera to obtain maximum lengths and projected areas of 100 particles, values of SF1 are calculated through the above-described equation, and an average value thereof is obtained.

External Additives

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a treatment with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles, such as polystyrene, PMMA, and melamine resin particles) and a cleaning activator (e.g., metal salt of a higher fatty acid represented by zinc stearate, and fluorine polymer particles).

The amount of the external additives to be externally added is, for example, preferably from 0.01% by weight to 5% by weight, and more preferably from 0.01% by weight to 2.0% by weight with respect to the toner particles.

Method of Preparing Toner

Next, the method of preparing the toner according to the exemplary embodiment will be described.

The toner according to the exemplary embodiment is obtained by externally adding the external additives to the toner particles after preparing the toner particles.

The toner particles may be prepared by any of a dry preparing method (e.g., a kneading and pulverizing method) and a wet preparing method (e.g., an aggregation and coalescence method, a suspending and polymerizing method, and a dissolving and suspending method). The preparing method of the toner particles is not particularly limited to these methods, and a known preparing method is employed.

Among these, the toner particle may be obtained by the aggregation and coalescence method.

Specifically, for example, when preparing the toner particles by the aggregation and coalescence method, the toner particles are prepared via a process (resin particle dispersion preparing process) of preparing a resin particle dispersion in which the resin particles which become the binder resin are dispersed; a process (aggregated particle forming process) of forming aggregated particles by aggregating the resin particles (other particles as necessary) in the resin particle dispersion (in the dispersion after mixing other particle dispersions therein as necessary); and a process (coalescing process) of forming the toner particles by heating an aggregated particle dispersion in which the aggregated particles are dispersed, and by coalescing the aggregated particles.

Hereinafter, each process will be described in detail.

In the description below, a method of obtaining the toner particles which contain the coloring agent and the release agent will be described, but the coloring agent and the release agent are used as necessary. It goes without saying that additives other than the coloring agent and the release agent may be used.

Resin Particle Dispersion Preparing Process

The coloring agent particle dispersion in which coloring agent particles are dispersed and a release agent dispersion in which release agent particles are dispersed, are prepared in addition to the resin particle dispersion in which the resin particles which become the binder resin are dispersed.

The resin particle dispersion is prepared, for example, by dispersing the resin particles in a dispersion medium by a surfactant.

Examples of the dispersion medium used for the resin particle dispersion include aqueous mediums.

Examples of the aqueous mediums include water such as distilled water and ion exchange water, and alcohol. These may be used alone or in combination of two or more kinds thereof.

Examples of the surfactant include anionic surfactants such as sulfate ester salt, sulfonate, phosphate, and soap anionic surfactants; cationic surfactants such as amine salt and quaternary ammonium salt cationic surfactants; and nonionic surfactants such as polyethylene glycol, alkylphenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

In the resin particle dispersion, examples of a dispersing method of the resin particles in the dispersion medium include a general dispersing method which uses a rotation shearing type homogenizer or a ball mill, a sand mill, or a DYNO mill, which each has a media. In addition, the resin particles may be dispersed in the resin particle dispersion by using a phase inversion emulsification method according to the type of the resin particles.

The phase inversion emulsification method is a method of performing resin inversion (so-called phase inversion) from W/O to O/W, making non-continuous phase, and dispersing the resin in the aqueous medium in a particle shape, by dissolving the resin to be dispersed into a hydrophobic organic solvent in which the resin is soluble, and putting aqueous medium (W phase) after performing neutralization by adding a base into an organic continuous phase (O phase).

The volume average particle diameter of the resin particles which are dispersed in the resin particle dispersion is preferably from 0.01 μm to 1 μm, and more preferably from 0.08 μm to 0.8 μm, and still more preferably from 0.1 μm to 0.6 μm, for example.

In the volume average particle diameter of the resin particles, the particle diameter distribution which is obtained by measurement of a laser diffraction type particle diameter distribution measurement apparatus (for example, LA-700 manufactured by Horiba, Ltd.) is used, the cumulative distribution regarding the volume from the small particle diameter side with respect to the divided particle diameter range (channel) is drawn, and 50% of the volume with respect to the entirety of the particles is set as the volume average particle diameter D50v. The volume average particle diameters of the particles in other dispersions are measured in a similar manner.

The content of the resin particle which is included in the resin particle dispersion is preferably from 5% by weight to 50% by weight, and more preferably from 10% by weight to 40% by weight.

Similarly to the resin particle dispersion, the coloring agent dispersion and the release agent dispersion are also prepared. In other words, the volume average particle diameter, the dispersion medium, and the dispersing method of the particles, and the content of the particle in the resin particle dispersion, are also similar in the coloring agent particles which are dispersed in the coloring agent dispersion and the release agent particles which are dispersed in the release agent dispersion.

Aggregated Particles Forming Process

Next, the coloring agent particle dispersion and the release agent particle dispersion are mixed with resin particle dispersion.

In addition, in the mixed dispersion, the resin particles, the coloring agent particles, and the release agent particles are heteroaggregated to form the aggregated particles which have a diameter which is close to a target diameter of the toner particles, and include the resin particles, the coloring agent particles, and the release agent particles.

Specifically, for example, the aggregated particles are formed by adding an aggregating agent into the mixed dispersion, adjusting pH of the mixed dispersion to be acidic (e.g., from pH 2 to pH 5), adding a dispersion stabilizer as necessary, and then, performing heating to the temperature close to the glass transition temperature of the resin particles (specifically, for example, from a temperature 30° C. lower than the glass transition temperature of the resin particles to a temperature 10° C. lower than the glass transition temperature), and aggregating the particles which are dispersed in the mixed dispersion.

In the aggregated particle forming process, for example, heating may be performed after adding the aggregating agent at a room temperature (e.g., 25° C.) while stirring the mixed dispersion by the rotation shearing type homogenizer, adjusting pH of the mixed dispersion to be acidic (e.g., from pH 2 to pH 5), and adding the dispersion stabilizer as necessary.

Examples of the aggregating agent include a surfactant having a polarity reversed to that of the surfactant which is contained the mixed dispersion, inorganic metal salt, and a di- or higher-valent metal complex. When the metal complex is used as the aggregating agent, an amount of use of the surfactant is reduced, and charging characteristics are improved.

Together with the aggregating agent, an additive which forms a complex or a similar bond to a bond for the formation of a complex, with the metal ion of the aggregating agent, may be used as necessary. As the additive, a chelating agent may be appropriately used.

Examples of the inorganic metal salt include metal salt (e.g., calcium chloride, calcium nitrate, barium chloride, magnesium chloride, zinc chloride, aluminum chloride, and aluminum sulfate), and an inorganic metal salt polymer (e.g., polyaluminum chloride, polyaluminium hydroxide, and calcium polysulfide).

As the chelating agent, a water-soluble chelating agent may be used. Examples of the chelating agent include an oxycarboxylic acid (e.g., a tartaric acid, a citric acid, and a gluconic acid), and an aminocarboxylic acid (e.g., an iminodiacetic acid (IDA), a nitrilotriacetic acid (NTA), and an ethylenediaminetetraacetic acid (EDTA)).

An addition amount of the chelating agent is preferably from 0.01 parts by weight to 5.0 parts by weight, and more preferably 0.1 parts by weight to less than 3.0 parts by weight with respect to 100 parts by weight of the resin particles.

Coalescing Process

Next, the toner particles are formed by coalescing the aggregated particles by heating the aggregated particle dispersion in which the aggregated particles are dispersed, for example, at a temperature not lower than a glass transition temperature of the resin particles (e.g., equal to or greater than a temperature which is higher than the glass transition temperature of the resin particles by 10° C. to 30° C.).

In the above-described process, the toner particles are obtained.

After obtaining the aggregated particle dispersion in which the aggregated particles are dispersed, the toner particles may be prepared via a process of forming second aggregated particles by further mixing the aggregated particle dispersion and the resin particle dispersion in which the resin particles are dispersed, and aggregating the mixture so that the resin particles are further adhered to the surface of the aggregated particles, and a process of forming the toner particles having the core shell structure by heating the second aggregated particle dispersion in which the second aggregated particles are dispersed, and coalescing the second aggregated particles.

Here, after finishing the coalescing process, a known washing process, a solid-liquid separation process, and a drying process are performed on the toner particles which are formed in the solvent, and the toner particles which are in a dried state are obtained.

From the viewpoint of charge properties, preferably, the washing process may be sufficiently performed by displacement washing by the ion exchange water. In addition, the solid-liquid separation process is not particularly limited, but from the viewpoint of productivity, suction filtration, pressure filtration, or the like, may be performed preferably. In addition, the drying process is also not particularly limited, but from the viewpoint of productivity, freeze drying, flash jet drying, drying, vibration type fluidized drying, or the like, may be performed.

In addition, the toner according to the exemplary embodiment is prepared, for example, by adding and mixing the external additive into the obtained toner particles in a dried state. Mixing may be performed, for example, by a V blender, a HENSCHEL mixer, or a LöDIGE mixer. Furthermore, as necessary, by using a vibration classifier or a wind classifier, coarse particles of the toner may be removed.

Image Forming Apparatus/Image Forming Method

The image forming apparatus according to the exemplary embodiment is provided with an image holding member; a charging unit that charges a surface of the image holding member, an electrostatic charge image forming unit that forms an electrostatic charge image on the charged surface of the image holding member; a developing unit which accommodates an electrostatic charge image developer containing a toner and a carrier, and develops the electrostatic charge image formed on the surface of the image holding member as a toner image by using the electrostatic charge image developer; a transfer unit which transfers the toner image formed on the surface of the image holding member onto a surface of a recording medium; a fixing unit that fixes the toner image transferred onto the surface of the recording medium; and a replenishing unit which accommodates a replenishment toner and a replenishment carrier, and replenishes the electrostatic charge image developer in the developing unit with the replenishment toner and the replenishment carrier.

In the image forming apparatus according to the exemplary embodiment, the electrostatic charge image developer set according to the exemplary embodiment is employed, the developing unit accommodates the electrostatic charge image developer for constituting the electrostatic charge image developer set according to the exemplary embodiment at the beginning of the use of the developing unit, and the replenishing unit accommodates the replenishment toner and the second carrier for constituting the electrostatic charge image developer set according to the exemplary embodiment.

In the image forming apparatus according to the exemplary embodiment, an image forming method (image forming method according to the exemplary embodiment) including a charging process of charging a surface of an image holding member; an electrostatic charge image forming process of forming an electrostatic charge image on the charged surface of the image holding member; a developing process of developing the electrostatic charge image formed on the surface of the image holding member as a toner image by using the developing unit which accommodates the electrostatic charge image developer containing a toner and a carrier; a transfer process of transferring the toner image formed on the surface of the image holding member onto a surface of a recording medium; a fixing process of fixing the toner image transferred onto the surface of the recording medium; and a replenishing process of replenishing the electrostatic charge image developer in the developing unit with a replenishment toner and a replenishment carrier, is performed.

In the image forming method according to the exemplary embodiment, the electrostatic charge image developer set according to the exemplary embodiment is employed, the developing unit accommodates the electrostatic charge image developer for constituting the electrostatic charge image developer set according to the exemplary embodiment at the beginning of the use of the developing unit, and the replenishing process replenishes the electrostatic charge image developer in the developing unit with the replenishment toner and the second carrier for constituting the electrostatic charge image developer set according to the exemplary embodiment.

As the image forming apparatus according to the exemplary embodiment, a known image forming apparatus is applied, such as a direct transfer-type apparatus which directly transfers the toner image formed on the surface of the image holding member to the surface of the recording medium; an intermediate transfer-type apparatus which primarily transfers the toner image formed on the surface of the image holding member onto a surface of an intermediate transfer member, and secondarily transfers the toner image transferred onto the surface of the intermediate transfer member onto the surface of the recording medium; an apparatus which includes a cleaning unit that cleans the surface of the image holding member, after transferring the toner image and before charging; and an apparatus which includes an erasing unit that performs erasing by irradiating the surface of the image holding member with erasing light, after transferring the toner image and before charging.

In a case where the image forming apparatus according to the exemplary embodiment is an intermediate transfer-type apparatus, a transfer unit includes, for example, an intermediate transfer member having a surface onto which a toner image is to be transferred, a primary transfer unit that primarily transfers a toner image formed on the surface of the image holding member onto the surface of the intermediate transfer member, and a secondary transfer unit that secondarily transfers the toner image transferred onto the surface of the intermediate transfer member onto the surface of the recording medium.

In the image forming apparatus according to the exemplary embodiment, for example, a part including the developing unit and the replenishing unit may have a cartridge structure (process cartridge) which is detachable from the image forming apparatus. As the process cartridge, for example, a process cartridge which is provided with the developing unit that accommodates the electrostatic charge image developer for constituting the electrostatic charge image developer set according to the exemplary embodiment, and the replenishing unit that accommodates the replenishment toner and the second carrier for constituting the electrostatic charge image developer set according to the exemplary embodiment is preferably used.

Hereinafter, the developing unit and the replenishing unit according to the exemplary embodiment will be described in more detail.

The developing unit employs a trickle developing type which discharges the developer (deteriorated developer) containing a large amount of deteriorated carrier while replenishing the toner and the carrier.

The developing unit is provided with, for example, the developer accommodation chamber which accommodates the developer; an stirring unit (e.g., screw) which is provided in the developer accommodation chamber, and agitates and transports the developer; a developing member (e.g., roll-shaped member) which holds the toner and transports the toner to the surface of the image holding member; a toner replenishing port which receives the replenishment toner; a carrier replenishing port which receives the replenishment carrier; and a developer discharge port which discharges the deteriorated developer. It is preferable that the toner replenishing port, the carrier replenishing port, and the developer discharge port are respectively provided in the developer accommodation chamber, and are mechanisms which may be opened and closed.

Inside the developer accommodation chamber, the developer is stirred by the stirring unit, and the toner is charged by friction between the toner and the carrier. A part of the charged toner is held by the developing member and transported to the surface of the image holding member. The developer accommodation chamber is replenished with the toner and the carrier from the toner replenishing port and the carrier replenishing port, and meanwhile, the developer which contains a large amount of carrier deteriorated by the agitation is slowly discharged from the developer discharge port.

The replenishing unit is provided with, for example, a replenishment toner accommodation chamber which accommodates the replenishment toner, a replenishment carrier accommodation chamber which accommodates the replenishment carrier, a toner replenishing path which links the replenishment toner accommodation chamber and the developing unit to each other, and a carrier replenishing path which links the replenishment carrier accommodation chamber and the developing unit to each other. The replenishment toner accommodation chamber and the replenishment carrier accommodation chamber may be a cartridge which may be detachable from the image forming apparatus.

In addition, the toner replenishing path and the carrier replenishing path may be one path being linked to each other in front of the developing unit, and in this case, one replenishing port which functions as both the toner replenishing port and the carrier replenishing port may be provided in the developing unit.

In addition, in the replenishing unit, one accommodation chamber which functions as both the replenishment toner accommodation chamber and the replenishment carrier accommodation chamber may be provided, and a developer which is mixed with the replenishment toner and the second carrier may be accommodated in the accommodation chamber.

In the developer which is accommodated in the developer accommodation chamber of the developing unit, the mixing ratio (weight ratio) between the toner and the carrier is preferably from 3:100 to 12:100, and more preferably from 5:100 to 9:100. It is preferable that a developer which satisfies this range is accommodated in the developer accommodation chamber at the beginning of the use. In addition, it is preferable that the developing unit is replenished with the replenishment toner and the replenishment carrier from the replenishing unit so as to satisfy this range.

In the image forming apparatus and the image forming method according to the exemplary embodiment, it is preferable that the developer which is accommodated in the developing unit satisfies the following Expression (3).

$$0.6 \leq B'/B \leq 1.4 \qquad \text{Expression (3)}$$

B and B' in Expression (3) are total weights of the developer which is accommodated in the developing unit. The total weight before forming 30,000 images having a toner applied amount of 4.2 g/m$^2$ and an area of 0.06 m$^2$ is B, and the total weight after forming images is B'.

In a case where the image is formed according to the above-described conditions, when a change in the amount of the developer which is accommodated in the developing unit is within the range of Expression (3), formation of an auger mark which is caused when the image forming is repeated over a long period of time is prevented.

Hereinafter, an example of the image forming apparatus according to the exemplary embodiment will be described, but the exemplary embodiment is not limited thereto. In the following description, main parts illustrated in the drawing will be described, and the description of other parts will be omitted.

FIG. 1 is a schematic configuration view illustrating the image forming apparatus according to the exemplary embodiment.

The image forming apparatus illustrated in FIG. 1 is provided with first to fourth electrophotographic image forming units 10Y, 10M, 10C, and 10K (image forming units) which output images of each colors, such as yellow (Y), magenta (M), cyan (C), and black (K), based on color-separated image data. These image forming units (hereinafter, there is a case where the image forming unit is simply referred to as a "unit") 10Y, 10M, 10C, and 10K are aligned in parallel to be separated from each other by a preset distance in a horizontal direction. These units 10Y, 10M, 10C, and 10K may be process cartridges which are detachable from the image forming apparatus.

At an upper part of the drawing of each unit 10Y, 10M, 10C, and 10K, an intermediate transfer belt 20 passes through each unit and extends as the intermediate transfer member. The intermediate transfer belt 20 is provided to be wound around a driving roll 22 and a supporting roll 24 which is in contact with an inner surface of the intermediate transfer belt 20, which are disposed to be separated from each other from left to right in the drawing, and travels in a direction toward the fourth unit 10K from the first unit 10Y. In addition, a force is applied to the supporting roll 24 in a direction away from the driving roll 22 by a spring or the like, which is not illustrated, and a tension is given to the intermediate transfer belt 20 which is wound around both the driving roll 22 and the supporting roll 24. In addition, on the image holding member side of the intermediate transfer belt 20, an intermediate transfer member cleaning is provided facing the driving roll 22.

The image forming apparatus illustrated in FIG. 1 is provided with a replenishing device (replenishing unit) which includes replenishment chambers 8Y, 8M, 8C, and 8K, and replenishing path (not illustrated). The developing devices (developing units) 4Y, 4M, 4C, and 4K of each of units 10Y, 10M, 10C, and 10K are respectively connected to the replenishment chambers 8Y, 8M, 8C, and 8K by the replenishing path. The replenishment chambers 8Y, 8M, 8C, and 8K are respectively provided in the attachable and detachable replenishment toner accommodation chamber (not illustrated) and the attachable and detachable replenishment carrier accommodation chamber (not illustrated), and the developing devices 4Y, 4M, 4C, and 4K are replenished with the toner and the carrier of each color from the replenishment chambers 8Y, 8M, 8C, and 8K.

Since the first to the fourth units 10Y, 10M, 10C, and 10K have the same configurations as each other, here, the first unit 10Y which is arranged on an upstream side of a traveling direction of an intermediate transfer belt and which forms a yellow image, will be described as a representative example. In addition, by providing reference numerals with magenta (M), cyan (C), and black (K) at a similar part to that of the first unit 10Y, instead of yellow (Y), the description of the second to the fourth units 10M, 10C, and 10K will be omitted.

The first unit 10Y has a photoreceptor 1Y which operates as the image holding member. In the periphery of the photoreceptor 1Y, a charging roll (an example of the charging unit) 2Y which charges a front surface of the photoreceptor 1Y to a preset potential, an exposure device (an example of the electrostatic charge image forming unit) 3 which forms the electrostatic charge image by exposing the charged surface by using a laser beam 3Y based on a color-separated image signal, a developing device (an example of the developing unit) 4Y which supplies the charged toner to the electrostatic charge image and develops the electrostatic charge image, a primary transfer roll 5Y (an example of the primary transfer unit) which transfers the developed toner image onto the intermediate transfer belt 20, and a photoreceptor cleaning device (an example of the cleaning unit) 6Y which removes the toner that remains on the surface of the photoreceptor 1Y after the primary transfer, are disposed in order.

The primary transfer roll 5Y is disposed on an inner side of the intermediate transfer belt 20, and is provided at a position which faces the photoreceptor 1Y. Each of bias supplies (not illustrated) which apply a primary transfer bias are connected to each of primary transfer rolls 5Y, 5M, 5C, and 5K. Each bias supply varies the transfer bias applied to each of the primary transfer rolls, by a control of a control portion which is not illustrated.

Hereinafter, an operation of forming the yellow image in the first unit 10Y will be described.

First, before the operation, a surface of the photoreceptor 1Y is charged to a potential having −600 V to −800 V by using the charging roll 2Y.

The photoreceptor 1Y is formed by layering a photosensitive layer on a substrate having conductivity (for example, a volume resistivity at 20° C.: $1\times10^{-6}$ Ωcm or less). The photosensitive layer generally has high resistance (resistance of a general resin), but it has a property that the photosensitive layer is irradiated with the laser beam 3Y, specific resistance of a part which is irradiated with the laser beam changes. Here, the laser beam 3Y is output to the surface of the charged photoreceptor 1Y via the exposure device 3, according to the image data for yellow which is sent from the control portion that is not illustrated. The photosensitive layer of the surface of the photoreceptor 1Y is irradiated with the laser beam 3Y, and accordingly, the electrostatic charge image having a yellow image pattern is formed on the surface of the photoreceptor 1Y.

The electrostatic charge image is an image which is formed on the surface of the photoreceptor 1Y by charging, and is a so-called negative latent image which is formed as the specific resistance of the irradiated part of the photosensitive layer decreases by the laser beam 3Y, and a charge on the surface of the photoreceptor 1Y flows, and meanwhile, the charge at a part which is not irradiated with the laser beam 3Y remains.

The electrostatic charge image formed on the photoreceptor 1Y is rotated up to a preset development position according to the traveling of the photoreceptor 1Y. At this development position, the electrostatic charge image on the photoreceptor 1Y is developed and visualized as the toner image, by a developing device 4Y.

In the developing device 4Y, for example, the electrostatic charge image developer which includes at least the yellow toner and the carrier is accommodated. The yellow toner is friction-charged by agitation in the developing device 4Y, and has a charge having the same polarity (negative polarity) as a band charge on the photoreceptor 1Y and is held on a developer roll (an example of a developer holding member).

As the surface of the photoreceptor 1Y passes through the developing device 4Y, the yellow toner is electrostatically adhered to a latent image portion which is erased on the surface of the photoreceptor 1Y, and the latent image is developed by the yellow toner. The photoreceptor 1Y in which the yellow toner image is formed travels continuously at a preset speed, and the toner image which is developed on the photoreceptor 1Y is transported to a preset primary transfer position.

Since the toner is consumed as the image forming is repeated, the developing device 4Y is replenished with the yellow toner which is in the replenishment chamber 8Y. In addition, the developing device 4Y is also replenished with the carrier from the replenishment chamber 8Y. The developing device 4Y has the developer discharge port (not illustrated) and gradually discharges the developer which includes a large amount of deteriorated carrier.

When the yellow toner image on the photoreceptor 1Y is transported to the primary transfer position, a primary transfer bias is applied to the primary transfer roll 5Y, the electrostatic force toward the primary transfer roll 5Y from the photoreceptor 1Y acts on the toner image, and the toner image on the photoreceptor 1Y is transferred onto the intermediate transfer belt 20. The transfer bias which is applied at this time has a (+) polarity reverse to (−) polarity of the toner, and for example, is controlled to be +10 μA by the control portion (not illustrated) in the first unit 10Y.

Meanwhile, the toner which remains on the photoreceptor 1Y is removed and collected by the photoreceptor cleaning device 6Y.

A first transfer bias which is applied to the first transfer rolls 5M, 5C, and 5K of the second unit 10M and subsequent units is also controlled according to the first unit.

In this manner, the intermediate transfer belt 20 in which the yellow toner image is transferred by the first unit 10Y is transported sequentially in order through the second to the fourth units 10M, 10C, and 10K, and the toner images having each color are superimposed and multiply transferred.

The intermediate transfer belt 20 to which the toner images of four colors are multiply transferred through the first to the fourth units, reaches a secondary transfer portion which is configured of the intermediate transfer belt 20, the supporting roll 24 which is in contact with the inner surface of the intermediate transfer belt, and a secondary transfer roll (an example of the secondary transfer unit) 26 which is disposed on an image holding surface side of the intermediate transfer belt 20. Meanwhile, a recording paper sheet (an example of the recording medium) P is supplied at a preset timing to a gap between which the secondary transfer roll 26 and the intermediate transfer belt 20 which contact with each other, via a supply mechanism, and a secondary transfer bias is applied to the supporting roll 24. The transfer bias which is applied at this time has (−) polarity which is the same polarity as (−) polarity of the toner, the electrostatic force toward the recording paper sheet P from the intermediate transfer belt 20 acts on the toner image, and the toner image on the intermediate transfer belt 20 is transferred onto the recording paper sheet P. In addition, the secondary transfer bias at this time is determined according to the resistance which is detected by a resistance detecting unit (not illustrated) that detects resistance of the secondary transfer portion, and is voltage-controlled.

After this, the recording paper sheet P is sent into a press contact portion (nipped portion) of a pair of fixing rolls in a fixing device (an example of the fixing unit) 28, the toner image is fixed onto the recording paper sheet P, and the fixed image is formed.

Examples of the recording paper sheet P to which the toner image is transferred include a plain paper sheet which is used in an electrophotographic type copying machine or a printer. In addition to the recording paper sheet P, examples of the recording medium also include an OHP sheet or the like.

In order to further improve the smoothness of the surface of the image after fixing is performed, it is preferable that the surface of the recording paper sheet P is also smooth, and for example, a coated paper sheet which is prepared by coating a surface of the plain paper sheet with resin or the like, or an art paper sheet for printing, is preferably used.

The recording paper sheet P on which the fixing of the color image is completed is discharged toward a discharge portion, and a series of the color image forming operations ends.

Process Cartridge

A process cartridge according to the exemplary embodiment will be described.

The process cartridge according to the exemplary embodiment includes the developing unit which accommodates the electrostatic charge image developer containing the toner and the carrier, and develops the electrostatic charge image formed on the surface of the image holding member as the toner image by using the electrostatic charge image developer; and the replenishing unit which accommodates the replenishment toner and the replenishment carrier, and replenishes the replenishment toner and the replenishment carrier to the electrostatic charge image developer in the developing unit. The process cartridge is attachable to and detachable from the image forming apparatus.

In the process cartridge according to the exemplary embodiment, the electrostatic charge image developer set according to the exemplary embodiment is employed, the developing unit accommodates the electrostatic charge image developer which configures the electrostatic charge image developer set according to the exemplary embodiment, and the replenishing unit accommodates the replenishment toner and the second carrier which configures the electrostatic charge image developer set according to the exemplary embodiment.

The process cartridge according to the exemplary embodiment is not limited to the above-described configuration, and may be configured to include the developing unit, the replenishing unit, and at least one selected from other units, such as the image holding member, the charging unit, the electrostatic charge image forming unit, or the transfer unit, as necessary.

Example

Hereinafter, the present invention will be described in more detail by using Example, but the invention is not limited to the following Example unless the contents are within the scope of the invention.

In the following description, "parts" and "%" are on a weight basis if there is no particular notice.

Preparation of Toner

Preparation of Styrene Acrylic Resin Particle Dispersion

Styrene: 320 parts n-butyl acrylate: 80 parts

Acrylic acid: 12 parts 10-dodecanthiol: 2 parts

A mixture which is prepared by mixing and dissolving the above-described materials is emulsified and dispersed is added to 550 parts of ion exchange water to which 6 parts of nonionic surfactant (NONYPOL 400 manufactured by Sanyo Chemical Co., Ltd.) and 10 parts of anionic surfactant (NEOGEN SC manufactured by DKS Co., Ltd.) in a flask, and while mixing the resultant for 10 minutes slowly, 50 parts of ion exchange water to which 4 parts of ammonium persulfate is added is put thereto. After performing nitrogen substitution, while stirring the inside of the flask, the contents are heated in an oil bath up to 70° C., and emulsion-polymerization is continued for 5 hours. As a result, a styrene acrylic resin particle dispersion (1) having a volume average particle diameter (D50v) of 210 nm, a glass transition temperature (Tg) of 50° C., a weight average molecular weight (Mw) of 38,000, and a solid content of 30% is obtained.

Preparation of Release Agent Dispersion

Paraffin wax (HNP-9 manufactured by Nippon Seiro Co., Ltd.): 50 parts

Anionic surfactant (NEOGEN SC manufactured by DKS Co., Ltd.): 2 parts

Ion exchange water: 200 parts

After heating the above-described materials to 120° C., and sufficiently mixing and dispersing the materials by using a homogenizer (ULTRA-TURRAX T50 manufactured by IKA), dispersion processing is performed by a pressure discharge type homogenizer, and a release agent dispersion (1) having a volume average particle diameter of 200 nm and a solid content of 20% is obtained.

Preparation of Coloring Agent Dispersion

Cyan pigment (C.I. Pigment Blue 15:3 manufactured by Dainichiseika Color & Chemicals Mfg. Co., Ltd.): 20 parts Anionic surfactant (NEOGEN SC manufactured by DKS Co., Ltd.): 2 parts Ion exchange water: 80 parts By mixing the above-described materials, and dispersing the mixture for 1 hour by using a high pressure impact type dispersing machine ultimizer (HJP30006 manufactured by Sugino Machine Limited), a coloring agent dispersion (1) having a volume average particle diameter of 180 nm and a solid content of 20% is obtained.

Preparation of Toner Particles

Styrene acrylic resin particle dispersion (1): 200 parts

Release agent dispersion (1): 30 parts

Coloring agent dispersion (1): 25 parts

Polyaluminum chloride: 0.4 parts

Ion exchange water: 100 parts

After putting the above-described materials into a flask made of stainless steel, mixing the materials by using the homogenizer (ULTRA-TURRAX T50 manufactured by IKA), and dispersing the mixture, the temperature is heated up to 48° C. while stirring the flask by the oil bath for heating. After keeping the mixture for 30 minutes at 48° C., here, 70 parts of styrene acrylic resin particle dispersion (1) is added thereto.

Then, after adjusting the pH in a system to 8.0 by using sodium hydroxide aqueous solution having 0.5 mol/L of concentration, the flask made of stainless steel is tightly closed, and while continuing stirring by magnetically sealing an stirring shaft, the temperature is heated up to 90° C., and the mixture is held for 3 hours. After completing the reaction, cooling is performed at 2° C./minute of temperature lowering speed, filtering is performed, and washing by the ion exchange water is performed. Then, solid-liquid separation is performed by Nutsche type suction filtration. Further, this is further dispersed again by using 3 L of ion exchange water at 30° C., stirring is performed at 300 rpm for 15 minutes, and washing is performed. This washing operation is repeated 6 times, and when pH of the filtrate is 7.54 and electric conductivity is 6.5 μS/cm, solid-liquid separation is performed by using No. 5A filter paper by Nutsche type suction filtration. Next, vacuum drying is continued for 12 hours, and the toner particles are obtained. The toner particles have a volume average particle diameter of 6.5 μm, a volume average particle diameter distribution index of 1.2, and a shape factor SF1 of 122.

External Addition of External Additive 1.2 parts of hydrophobic titania (JMT2000 manufactured by Fuji Titanium Industry Co., Ltd.) and 1.8 parts of hydrophobic silica (RY50 manufactured by Nippon Aerosil Co., Ltd.) are added into 100 parts of toner particles, and the resultant is mixed by using a HENSCHEL mixer to obtain an externally added toner.

Preparation of Carrier A

Carriers A1 to A4 which are a resin coating type magnetic carriers and contain silicone particles that are not oil treated in the coating layer are prepared.

Carrier A1

Preparation of Silicone Particles 100 parts of methyl vinyl polysiloxane and 10 parts of methyl hydrogen siloxane are mixed with each other, 30 parts of calcium carbonate powder (number average particle size: 0.1 μm, TP-123 manufactured by Okutama Kogyo Co., Ltd.), 1 part of polyoxyethylene octylphenylether, and 200 parts of water are added into the mixture, and emulsification is performed for 3 minutes at 6,000 rpm by a mixer. After this, chloroplatinic acid-olefin complex salt is added in an amount of 0.001 parts as an amount of platinum, and polymerization-reaction is performed for 10 hours at 80° C. under a nitrogen atmosphere. Then, after putting hydrochloric acid thereto to decompose calcium carbonate, washing is performed with water. By wet classification, porous elastomer particles having target volume particle diameter D16v and volume particle diameter D50v are collected, vacuum drying is performed for 12 hours at 100° C., and thus the silicone particles are obtained.

Preparation of Magnetic Carrier 2,000 parts of ferrite particles (Mn—Mg ferrite, true specific gravity: 4.7 g/cm$^3$, volume average particle diameter: 45 μm, saturation magnetization: 60 emu/g, surface roughness: 1.5 μm) are put into a vacuum degassing type kneader having a volume of 5 L, and further, 380 parts of a resin coating layer forming solution is put thereto. While stirring, the pressure is reduced down to −200 mmHg at 60° C. and stirring is continued for 20 minutes. Then, the temperature is increased and the pressure is reduced, and stirring is performed for 30 minutes at 70° C./−720 mHg for drying, thereby obtaining resin coating particles. Next, classification is performed by using a sieve having an aperture of 75 μm to obtain a carrier. 0.1 parts of silicone particles are added to 100 parts of the obtained carrier, stirring is performed for 15 minutes at 40 rpm by using a V blender, and thus the carrier A1 is obtained.

Composition of Resin Coating Layer Forming Solution

Cyclohexyl methacrylate/dimethylaminoethyl copolymer resin: 3 parts

Toluene: 20 parts

Measurement of Total Energy Amount 92 parts of the carrier A1 and 8 parts of the externally added toner are put into a V blender, stirred for 20 minutes, and mixed with each other. After this, by classifying the mixture by using a sieve having an aperture of 212 μm, a developer is prepared.

After keeping this developer for 17 hours under an environment in which the temperature is 25° C. and humidity is 25% RH, the total energy amount is measured according to the above-described operations and conditions by using a powder rheometer (FT4 manufactured by Freeman Technology).

Carrier A2

Carrier A2 is prepared in the same manner as in the preparation of the carrier A1, except that the amount of silicone particles is changed to 0.01 parts.

Carrier A3

Carrier A3 is prepared in the same manner as in the preparation of the carrier A1, except that the silicone particles are not added.

Carrier A4

Carrier A4 is prepared in the same manner as in the preparation of the carrier A1, except that the volume average particle diameter of ferrite particles is changed to 35 μm.

Preparation of Carrier B

Carriers B1 to B4, which are resin coating type magnetic carriers and contain oil treated silicone particles in the coating layer, are prepared.

Carrier B1

Preparation of Oil Treated Silicone Particles 100 parts of methyl vinyl polysiloxane and 10 parts of methyl hydrogen siloxane are mixed with each other, 30 parts of calcium carbonate powder (average particle size: 0.1 μm, TP-123 manufactured by Okutama Kogyo Co., Ltd.), 1 part of polyoxyethylene octylphenylether, and 200 parts of water are added into the mixture, and emulsification is performed for 3 minutes at 6,000 rpm by a mixer. After this, chloroplatinic acid olefin complex salt is added in an amount of 0.001 parts as an amount of platinum, and polymerization-reaction is performed for 10 hours at 80° C. under a nitrogen atmosphere. Then, after putting hydrochloric acid thereto to decompose calcium carbonate, washing is performed with water. By wet classification, porous elastomer particles having target volume particle diameter D16v and volume particle diameter D50v are collected, and vacuum drying is performed for 12 hours at 100° C.

Then, a solution prepared by dissolving 150 parts of dimethylsilicone oil into 1,000 parts of ethanol, is stirred and mixed with 100 parts of porous elastomer particles, ethanol being the solvent is distilled by using an evaporator and drying is performed, and thus the oil treated silicone particles are obtained.

Preparation of Magnetic Carrier 2,000 parts of ferrite particles (Mn—Mg ferrite, true specific gravity of 4.7 g/cm$^3$, volume average particle diameter of 45 μm, saturation magnetization of 60 emu/g, surface roughness of 1.5 μm) are put into a vacuum degassing type kneader having a volume of 5 L, and further, 380 parts of the following resin coating layer forming solution is put thereto. While stirring this, after reducing the pressure down to −200 mmHg at 60° C. and mixing this for 20 minutes, resin coating particles are obtained by increasing the temperature, reducing the pressure, stirring for 30 minutes at 70° C./−720 mHg, and drying. Next, classification by using a sieve having an aperture of 75 μm is performed, and the carrier is obtained. 0.12 parts of oil treated silicone particles are added to 100 parts of the obtained carrier, stirring is performed for 15 minutes at 40 rpm by using a V blender, and the carrier B1 is obtained.

Composition of Resin Coating Layer Forming Solution

Cyclohexyl methacrylate copolymer resin: 3 parts

Toluene: 20 parts

Analysis of Surface of Resin Particles by XPS

The carrier B1 is fixed to a sample holder of X-ray photoelectron spectrometer (JPS-9000MX manufactured by JEOL Ltd., excitation source Mg—Kα), and inserted into a chamber of the X-ray photoelectron spectrosmeter. XPS spectrum is measured by setting a degree of vacuum of the chamber to $1\times10^{-6}$ Pa or less and an output to 200 W. A spectrum in the vicinity of 100 eV is measured regarding Si—O, a spectrum in the vicinity of 110 eV is measured regarding Si 2p, a spectrum in the vicinity of 290 eV is measured regarding C 1s, a spectrum in the vicinity of 537 eV is measured regarding O 1s, a spectrum in the vicinity of 404 eV is measured regarding N 1s, a spectrum in the vicinity of 644 eV is measured regarding Mn 2p, a spectrum in the vicinity of 715 eV is measured regarding Fe 2p, a spectrum in the vicinity of 462 eV is measured regarding Ti 2p, a spectrum in the vicinity of 138 eV is measured regarding Sr 3d, a spectrum in the vicinity of 88 eV is measured regarding Mg 2s, and a spectrum in the vicinity of 694 eV is measured regarding F 1s. Based on the spectrums of each element, from a ratio between a spectrum strength of Si—O and a spectrum strength of other elements, a coverage by the resin particles on the surface of the carrier is obtained according to the following Expression.

$$\text{Si—O}/\{(\text{Si } 2p)+(\text{C } 1s)+(\text{O } 1s)+(\text{N } 1S)+(\text{Mn } 2p)+(\text{Fe } 2)+(\text{Ti } 2p)+(\text{Sr } 3d)+(\text{Mg } 2s)+(\text{F } 1s)\}\times100 \quad \text{Expression:}$$

Measurement of Total Energy Amount 92 parts of the carrier B1 and 8 parts of the externally added toner are put into a V blender, stirred for 20 minutes, and mixed with each other. After this, by classifying the mixture by using a sieve having an aperture of 212 μm, a developer is prepared.

After keeping this developer for 17 hours under an environment in which the temperature is 25° C. and humidity is 25% RH, the total energy amount is measured according to the above-described operations and conditions by using a powder rheometer (FT4 manufactured by Freeman Technology).

Carrier B2

Carrier B2 is prepared in a similar manner to the carrier B1, except that the amount of oil treated silicone particles is changed to 0.07 parts.

Carrier B3

Carrier B3 is prepared in a similar manner to the carrier B1, except that the amount of oil treated silicone particles is changed to 0.008 parts.

Carrier B4

Carrier B4 is prepared in a similar manner to the carrier B1, except that the volume average particle diameter of ferrite particles is changed to 35 μm.

Example 1

92 parts of the carrier A1 and 8 parts of the externally added toner are put into a V blender, stirred for 20 minutes, and mixed with each other. After this, by classifying the mixture by using a sieve having an aperture of 212 μm, a developer is prepared. A trickle developing type image forming apparatus (DOCUPRINT C3200A manufactured by Fuji Xerox Co., Ltd.) is prepared, and the above-described developer is put into the developing device. In addition, the carrier B1 and the externally added toner are put into the replenishment carrier accommodation chamber and the replenishment toner accommodation chamber, respectively.

Under an environment in which the temperature is 15° C. and humidity is 10%, an image having a toner applied amount of 4.2 g/m$^2$ and an area of 0.06 m$^2$ is formed on 30,000 sheets of paper (P paper sheet manufactured by Fuji Xerox Co., Ltd.). By monitoring the weight of the developing device before and after the image forming, a total weight ratio of the developer which is accommodated in the developing device is obtained.

In addition, the 30,000th image is observed with the naked eye, and the auger mark is evaluated according to the following standard. A and B are levels that practical use is possible without a problem.

Evaluation Standard

A: White stripes are not recognized.

B: White stripes are slightly recognized.

C: White stripes are recognized.

D: White stripes are apparently recognized.

Examples 2 to 4, Comparative Examples 1 to 12

An image is formed and evaluated in a similar manner to Example 1, except that combination of carriers is changed as indicated in Table 2.

Configurations and physical properties of each carrier are illustrated in Table 1, and configurations and evaluation results of each Example and each Comparative example are illustrated in Table 2.

TABLE 1

| | Configuration of carrier | | | | | | |
|---|---|---|---|---|---|---|---|
| Type of carrier | Resin particles | Oil treating of resin particles | Volume average particle diameter of resin particles | Weight ratio of resin particles in carrier | Coverage by resin particles on surface of carrier | Volume average particle diameter | Total energy amount |
| Carrier A1 | Silicone rubber | No | 5 μm | 0.1% | Not analyzed | 45 μm | 190 mJ |
| Carrier A2 | Silicone rubber | No | 5 μm | 0.01% | Not analyzed | 45 μm | 170 mJ |
| Carrier A3 | Absent | — | — | — | Not analyzed | 45 μm | 150 mJ |
| Carrier A4 | Silicone rubber | No | 5 μm | 0.1% | Not analyzed | 35 μm | 250 mJ |
| Carrier B1 | Silicone rubber | Yes | 5 μm | 0.12% | 1% | 45 μm | 240 mJ |
| Carrier B2 | Silicone rubber | Yes | 5 μm | 0.07% | 0.5% | 45 μm | 220 mJ |
| Carrier B3 | Silicone rubber | Yes | 5 μm | 0.008% | 0.1% | 45 μm | 180 mJ |
| Carrier B4 | Silicone rubber | Yes | 5 μm | 0.12% | 1% | 35 μm | 300 mJ |

TABLE 2

| | Type of Carrier | | Total weight ratio of developer (after/before | Auger |
|---|---|---|---|---|
| | Initial | Replenish | image forming) | mark |
| Example 1 | Carrier A1 | Carrier B1 | 0.95 | A |
| Example 2 | Carrier A2 | Carrier B1 | 0.70 | B |
| Comparative example 1 | Carrier A3 | Carrier B1 | 0.54 | D |
| Comparative example 2 | Carrier A4 | Carrier B1 | 1.50 | C |
| Example 3 | Carrier A1 | Carrier B2 | 0.95 | A |
| Example 4 | Carrier A2 | Carrier B2 | 0.65 | B |
| Comparative example 3 | Carrier A3 | Carrier B2 | 0.49 | D |
| Comparative example 4 | Carrier A4 | Carrier B2 | 1.45 | C |
| Comparative example 5 | Carrier A1 | Carrier B3 | 0.50 | D |
| Comparative example 6 | Carrier A2 | Carrier B3 | 0.45 | D |
| Comparative example 7 | Carrier A3 | Carrier B3 | 0.42 | D |
| Comparative example 8 | Carrier A4 | Carrier B3 | 0.52 | D |
| Comparative example 9 | Carrier A1 | Carrier B4 | 1.54 | C |
| Comparative example 10 | Carrier A2 | Carrier B4 | 1.45 | C |
| Comparative example 11 | Carrier A3 | Carrier B4 | 1.46 | C |
| Comparative example 12 | Carrier A4 | Carrier B4 | 1.60 | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A carrier set for electrostatic charge image developer, comprising:

a first carrier that satisfies Expression (1); 160 mJ≤x≤200 mJ, and a second carrier that satisfies Expression (2); 210 mJ≤y≤250 mJ, wherein x is a total energy amount, which is measured by a powder rheometer, of a developer which is prepared by mixing the first carrier and a toner for measurement such that a weight ratio of the toner is 8% by weight based on the developer, and y is a total energy amount, which is measured by the powder rheometer, of a developer which is prepared by mixing the second carrier and the toner for measurement such that a weight ratio of the toner is 8% by weight based on the developer.

2. The carrier set according to claim 1 wherein a value of x is within a range of 165 mJ to 195 mJ.

3. The carrier set according to claim 1, wherein a value of y is within a range of 215 mJ to 240 mJ.

4. The carrier set according to claim 1 wherein the second carrier contains a core containing magnetic particle, and a coating layer that contains a coating resin and oil treated resin particles, and the oil treated resin particles are exposed on a surface of the coating layer.

5. The carrier set according to claim 4, wherein the oil treated resin particles are silicone particles.

6. The carrier set according to claim 4, wherein the oil is silicone oil.

7. The carrier set according to claim 1, wherein the second carrier is a replenishment carrier to be added to the developer in which the first carrier is included.

8. An electrostatic charge image developer set, comprising:

an electrostatic charge image developer that contains a toner and a first carrier that satisfies Expression (1); 160 mJ≤x≤200 mJ, a replenishment toner, and a second carrier that satisfies Expression (2); 210 mJ≤y≤250 mJ, as a replenishment carrier, wherein x is a total energy amount, which is measured by a powder rheometer, of a developer which is prepared by mixing the first carrier and a toner for measurement such that a weight ratio of the toner is 8% by weight based on the developer, and y is a total energy amount, which is measured by the powder rheometer, of a developer which is prepared by mixing the second carrier and the toner for measurement such that a weight ratio of the toner is 8% by weight based on the developer.

9. The electrostatic charge image developer set according to claim 8, wherein the replenishment carrier contains a core containing magnetic particle and a coating layer that contains a coating resin and oil treated resin particles and coats the core, and wherein the oil treated resin particles are exposed on a surface of the coating layer.

10. The electrostatic charge image developer set according to claim 9, wherein the resin particles are silicone particles.

11. The electrostatic charge image developer set according to claim 9, wherein the oil is silicone oil.

12. A process cartridge that is detachable from an image forming apparatus, the process cartridge comprising:

a developing unit that accommodates an electrostatic charge image developer including a toner and a carrier, and develops the electrostatic charge image formed on a surface of an image holding member as a toner image by using the electrostatic charge image developer; and a replenishing unit that accommodates a replenishment toner and a replenishment carrier, and replenishes the electrostatic charge image developer in the developing unit with the replenishment toner and the replenishment carrier, wherein the electrostatic charge image developer is an electrostatic charge image developer that includes a first carrier that satisfies Expression (1); 160 mJ≤x≤200 mJ, and the replenishment carrier contains a second carrier which satisfies Expression (2); 210 mJ≤y≤250 mJ, wherein x is a total energy amount, which is measured by a powder rheometer, of a developer which is prepared by mixing the first carrier and a toner for measurement such that a weight ratio of the toner is 8% by weight based on the developer, and y is a total energy amount, which is measured by the powder rheometer, of a developer which is prepared by mixing the second carrier and the toner for measurement such that a weight ratio of the toner is 8% by weight based on the developer.

13. The process cartridge according to claim 12, wherein the replenishment carrier contains a core containing magnetic particle, and a coating layer that contains a coating resin and oil treated resin particles and coats the core, and wherein the oil treated resin particles are exposed on a surface of the coating layer.

14. The process cartridge according to claim 13, wherein the resin particles are silicone particles.

15. The process cartridge according to claim 13, wherein the oil is silicone oil.

* * * * *